US007875997B2

(12) United States Patent
George et al.

(10) Patent No.: US 7,875,997 B2
(45) Date of Patent: Jan. 25, 2011

(54) CIRCUIT INTERRUPTION DEVICE

(75) Inventors: Terry A. George, Salem, OH (US); Fran A. Kleja, Austintown, OH (US); Achim Rosemann, Schwelm (DE); Klaus Hold, Remscheid (DE)

(73) Assignee: Delphi Technologies, Inc., Troy, MI (US)

( * ) Notice: Subject to any disclaimer, the term of this patent is extended or adjusted under 35 U.S.C. 154(b) by 716 days.

(21) Appl. No.: 10/566,035

(22) PCT Filed: Aug. 6, 2004

(86) PCT No.: PCT/US2004/025481

§ 371 (c)(1),
(2), (4) Date: Feb. 5, 2008

(87) PCT Pub. No.: WO2005/015704

PCT Pub. Date: Feb. 17, 2005

(65) Prior Publication Data

US 2008/0137253 A1 Jun. 12, 2008

Related U.S. Application Data

(60) Provisional application No. 60/493,499, filed on Aug. 8, 2003.

(51) Int. Cl.
*H01H 35/14* (2006.01)

(52) U.S. Cl. ..... 307/117

(58) Field of Classification Search ..... 307/116, 307/117; 361/626, 628, 630, 642
See application file for complete search history.

(56) References Cited

U.S. PATENT DOCUMENTS

| | | | | |
|---|---|---|---|---|
| 2,892,062 | A | 6/1959 | Bruckner et al. | |
| 4,385,216 | A | 5/1983 | Cinquin | |
| 4,573,032 | A | 2/1986 | Hickey | |
| 4,920,446 | A | 4/1990 | Pflanz | |
| 5,019,937 | A * | 5/1991 | Beard | 361/102 |
| 5,303,111 | A * | 4/1994 | Yamaguchi | 361/19 |
| 5,536,980 | A * | 7/1996 | Kawate et al. | 307/116 |
| 6,492,747 | B1 | 12/2002 | Hoffmann | |
| 6,829,129 | B2 * | 12/2004 | Marsh et al. | 361/111 |

FOREIGN PATENT DOCUMENTS

| | | |
|---|---|---|
| DE | 1056249 | 4/1959 |
| DE | 10049071 | 4/2002 |
| EP | 0973184 | 1/2000 |
| EP | 1033803 | 9/2000 |
| WO | 8101770 | 6/1981 |
| WO | 9933079 | 7/1999 |

OTHER PUBLICATIONS

European Search Report dated Jan. 23, 2009.

* cited by examiner

*Primary Examiner*—Albert W Paladini
(74) *Attorney, Agent, or Firm*—Thomas N. Twomey

(57) ABSTRACT

A circuit interruption device (110) is provided in which an interruption element (112) and a fuse element (114) are configured electrically in parallel. The interruption element includes an electrical conductor and a current interrupter capable of severing the electrical conductor to eliminate its capacity to carry current. An exemplary embodiment of a circuit interruption device is capable of detecting an interrupt control signal and actuating in response to the signal.

2 Claims, 8 Drawing Sheets

CIRCUIT INTERRUPTION DEVICE

BACKGROUND OF THE INVENTION

This application claims benefit of priority from U.S. provisional patent application Ser. No. 60/493,499, filed Aug. 8, 2003, which is hereby incorporated by reference.

TECHNICAL FIELD

The present invention relates to a circuit protection device and more particularly to a device for protecting a load circuit of a battery.

Motor vehicles, such as cars, marine vessels, trucks and the like almost universally include a starter motor cable and other cables that conduct high current. For example, in a typical 12 volt electrical system common in many motor vehicles, a current traveling through a starter motor cable may initially surge to a level as high as 900 amps or, in some cases, to 1500 amps. In addition, the current through the starter cable may stabilize at a steady level between 200 to 600 amps, remaining at this level for up to six seconds, or more. Accordingly, the entire circuits that will supply current to such high-current devices, such as vehicle starter motors, may require a design that accommodates high levels of both steady state and transient current.

Unfortunately, however, any of the components of such high-current circuits, which may include, for example, the battery cables, may be short circuited to ground in any of a variety of ways, such as in a severe vehicle collision. For this reason, it would be advantageous to have fuse protection associated with these circuits. In many cases, however, components such as starter motor cables are not known to incorporate fuses for to protection of the circuit. One reason for this lack of fuse protection is the relatively large fuse size that would be required to support the current needed to power the circuit of the starter motor or other high-current device. Since some components within these high-current circuits, such as a battery cable, must also support low-current devices, fuse protection has proven difficult to implement. For example, a fuse that would be large enough to carry current required by the initial current surge in a vehicle starter motor circuit would provide little or no protection during the periods of time when current is not needed to operate the motor.

Devices have been disclosed for use in a battery circuit to open the circuit. For example, U.S. Pat. Nos. 6,144,111, 6,171,121, and 5,783,987 disclose such circuit interruption devices. In general, actuation of such devices is not easily reversed. While such devices generally serve to disable their associated circuits, the actuated device typically needs to be replaced to restore the circuit. Accordingly, the user of the device containing the protected circuit may be inconvenienced. For example, in the case of a motor vehicle, either towing or a jump-start to move the vehicle may be required, and a delay may be encountered before the vehicle is restored to operable condition.

It is desirable to remove voltage from the battery cable when a short occurs in the battery circuit vehicle. It is also known that such shorts may be caused by a vehicle collision. However, many collisions, such as those that may exceed a threshold level of deceleration or that may trigger an indication of a collision, such as may result in deployment of an airbag, may not also cause a short circuit in a high-current component, such as a battery cable. In such situations, it may be desirable to enable the vehicle to be restarted and/or to provide power to selected electrical loads. Unfortunately, any method or device for protecting a high-current circuit that involves disabling the protected circuit whenever a vehicle collision occurs may result in an unnecessary interruption of a protected circuit - even though no short circuit has occurred. Such over-protective measures may cause additional problems.

SUMMARY OF THE INVENTION

The present invention provides a circuit interruption device, in which an interruption element and a fuse element are configured electrically in parallel. In an exemplary embodiment the interruption element includes an electrical conductor coupled in parallel with the fuse element.

An exemplary embodiment further includes a current interrupter capable of severing the electrical conductor to eliminate its capacity to carry current. The interruption element has an initial state and an actuated state. When the interruption element is in the initial state, the electrical conductor provides a conductive path that is configured in parallel with the circuit path of fuse element. When the interruption element is in the actuated state, a gap created in the electrical conductor by the current interrupter prevents current from flowing through the electrical conductor.

An exemplary embodiment of a circuit interruption device of the present invention is capable of interrupting the current carrying capability of a battery cable between a battery and a device when the device receives a signal indicating an occurrence of an abnormal event, such as an airbag deployment, or a short in the battery circuit. An exemplary embodiment enables normal restarting of an automotive engine after a collision if a short is not present in the battery circuit.

An exemplary embodiment of a circuit interruption device of the present invention includes a current interrupter configured to detect an interrupt control signal. The current interrupter is further configured to actuate in response to a detection of the signal.

BRIEF DESCRIPTION OF TEE DRAWINGS

The above-mentioned features of the present invention can be more clearly understood from the following detailed description considered in conjunction with the following drawings, in which like numerals represent like elements and in which:

FIG. 1 is a schematic view of an exemplary embodiment of a circuit interruption device of the present invention;

FIG. 2*a* is a sectional view of an exemplary embodiment of a circuit interruption device of the present invention in an initial state;

FIG. 2*b* is a sectional view of an exemplary embodiment of a circuit interruption device of the present invention in an actuated state;

Figure 5A:
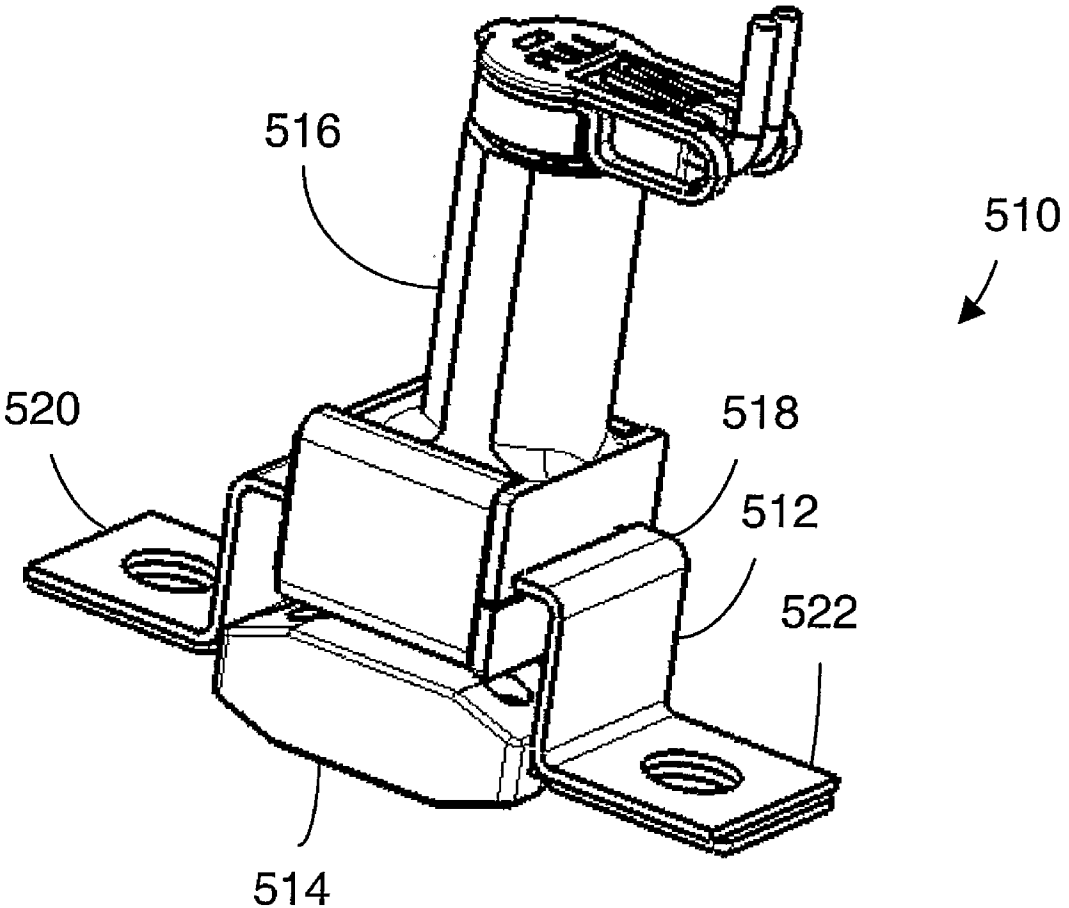
Figure 5B:
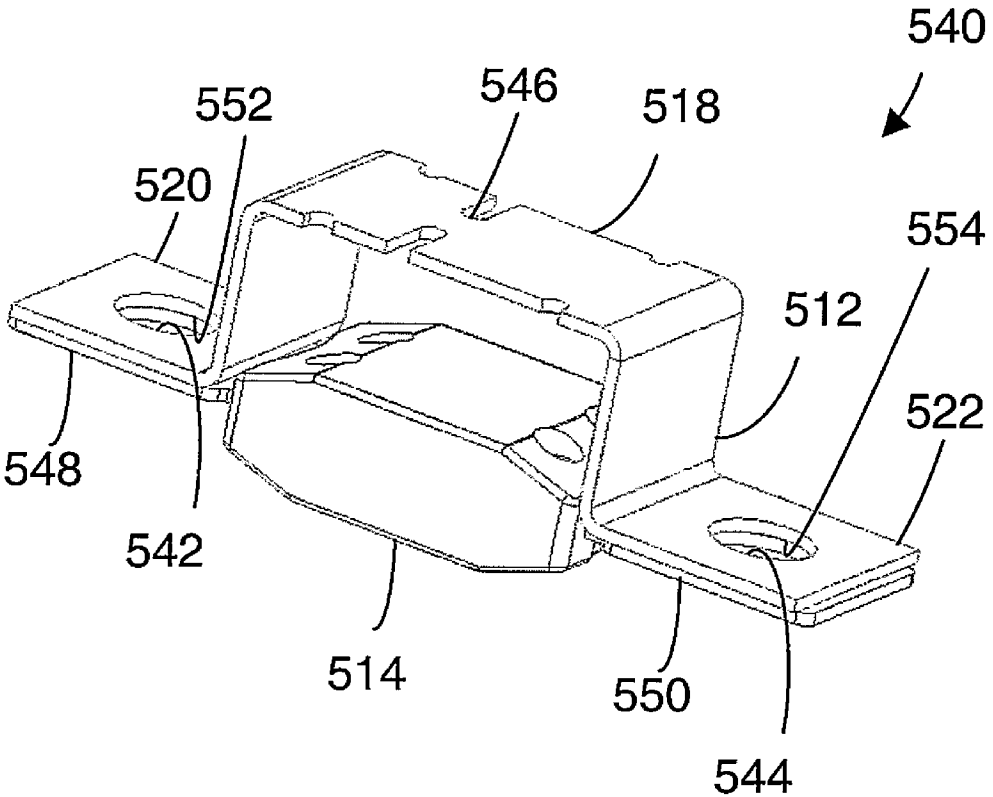

FIG. 5*a* is a perspective view illustrating another exemplary embodiment of a circuit interruption device of the present invention;

FIG. 5*b* is a perspective view of an aspect of the circuit interruption device of FIG. 5*a;*

Figure 6A:
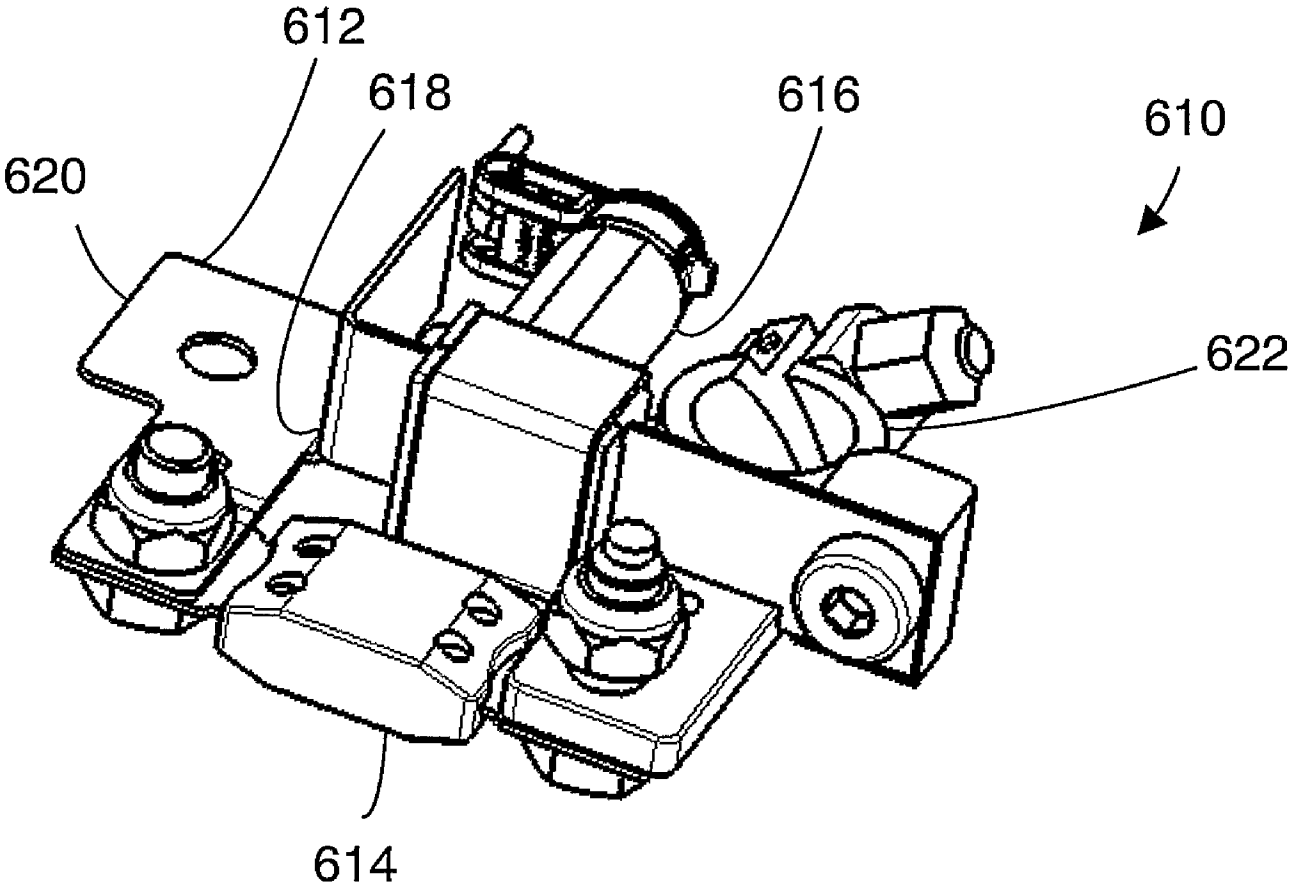
Figure 6B:
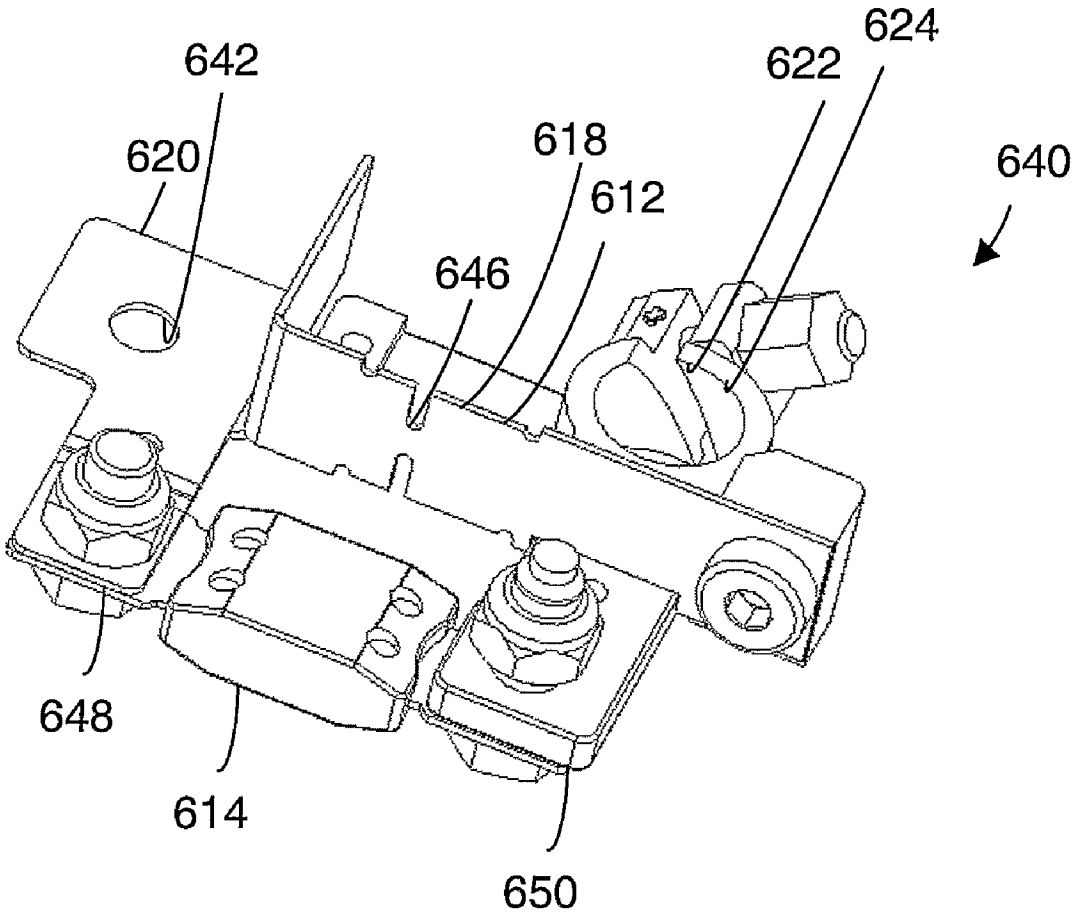

FIG. 6*a* is a perspective view illustrating yet another exemplary embodiment of a circuit interruption device of the present invention; and FIG. 6*b* is a perspective view of an aspect of the circuit interruption device of FIG. 6*a*.

DETAILED DESCRIPTION OF THE INVENTION

Figure 1:
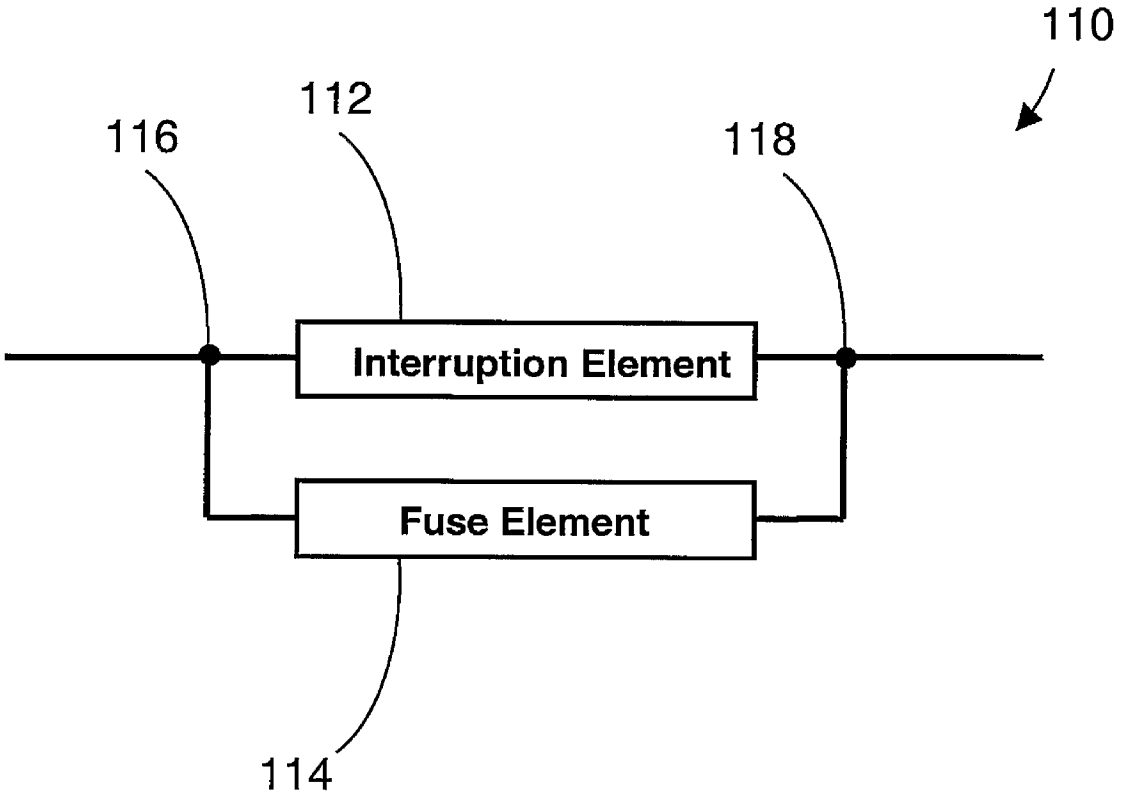

Referring now to FIG. 1 of the drawings, a safety device for an electrical circuit or circuit interruption device 110 of the present invention includes an interruption element 112 and a fuse element 114 coupled in parallel. Interruption element 112 and fuse element 114 are connected at respective ends at locations defined as first and second nodes 116, 118.

Figure 2B:
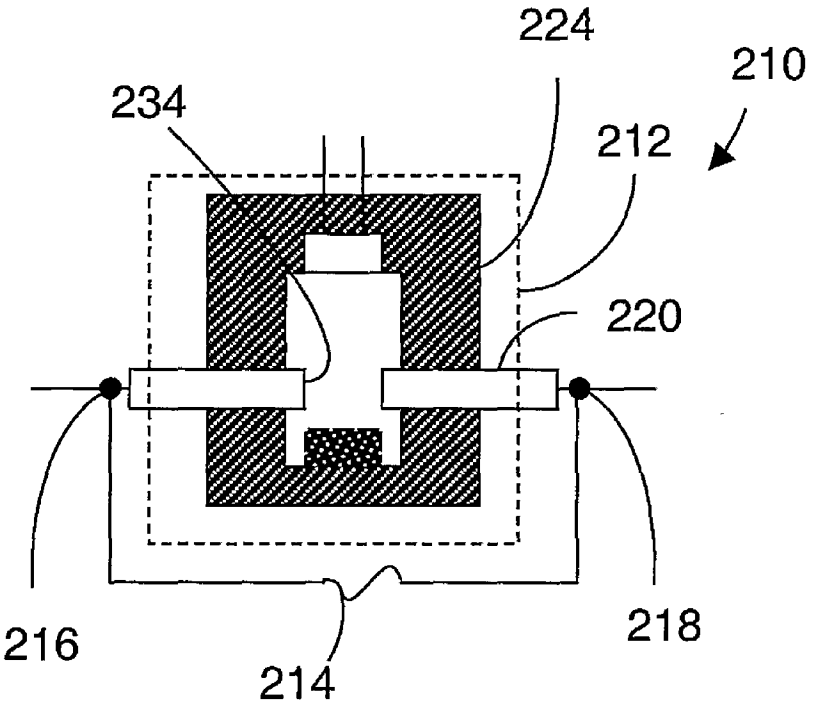
Figure 2A:
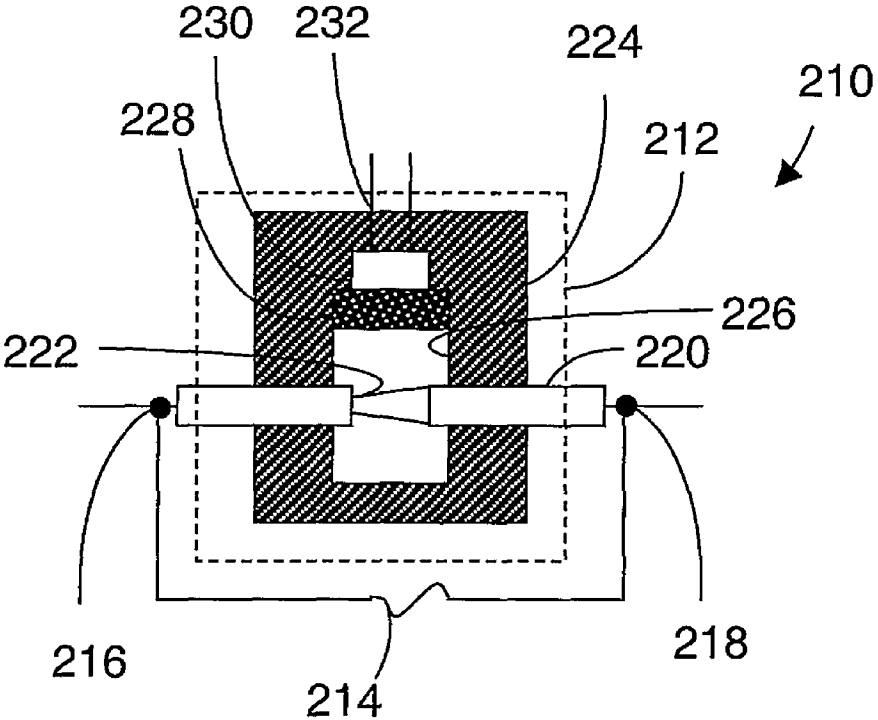

Referring now to FIG. 2*a*, an exemplary embodiment of circuit interruption device 210 includes an interruption element 212 and a fuse element 214 coupled in parallel. Interruption element 212 and fuse element 214 are connected at respective ends at locations defined as first and second nodes 216, 218. Interruption element 212 includes an electrical conductor 220 coupled with fuse element 214 in parallel. Electrical conductor 220 includes a narrowed juncture 222. Electrical conductor 220 is designed with appropriate material, cross-section and length to carry the majority of electrical current required by the electrical loads. In an exemplary embodiment, electrical conductor 220 is configured to ensure that fuse element 214 does not conduct enough current to melt or open under normal use.

In an exemplary embodiment, interruption element 212 also includes a current interrupter 224 capable of severing electrical conductor 220 to eliminate the capacity of electrical conductor 220 to carry current between first and second nodes 216, 218. Current interrupter 224 may be configured to sever electrical conductor 220 so as to prevent flow of current through electrical conductor 220 while leaving the current path extending through fuse element 214 in tact. In an exemplary embodiment, current interrupter 224 includes a firing chamber 226 partially filled with a pyrotechnic component 228. Current interrupter 224 may further include an ignition element 230 configured to activate pyrotechnic component 228 when ignition element 230 receives an interrupt control signal via wires 232. Circuit interruption device 210 may also include appropriate interconnects and sub-components necessary to control current interrupter 224.

Alternatively, interruption element 212 may include other appropriate means to open or break the current path extending through electrical conductor 220. For example, current interrupter 224 may include a knife (not shown). Or, electrical conductor 220 may include a switch (not shown) and current interrupter 224 may include a switch actuator. Alternatively, electrical conductor 220 may include a fuse (not shown), and current interrupter 224 may include a heating element (not shown), which is configured to melt the fuse (not shown) in response to an interrupt control signal received from a controlling module (shown on FIG. 3) or sensor (shown on FIG. 3).

FIG. 2*a* depicts interruption element 212 in an initial state. In an initial state, electrical conductor 220 provides a conductive path between first and second nodes 216, 218 parallel to fuse element 214.

FIG. 2*b* depicts interruption element 212 in an actuated state after current interrupter 224 has severed electrical conductor 220, interrupting the capacity of electrical conductor 220 to carry current between first and second nodes 216, 218. In the actuated state, a gap 234 created in electrical conductor 220 by current interrupter 224 prevents current from flowing through electrical conductor 220 between first and second nodes 216, 218.

Figure 3:
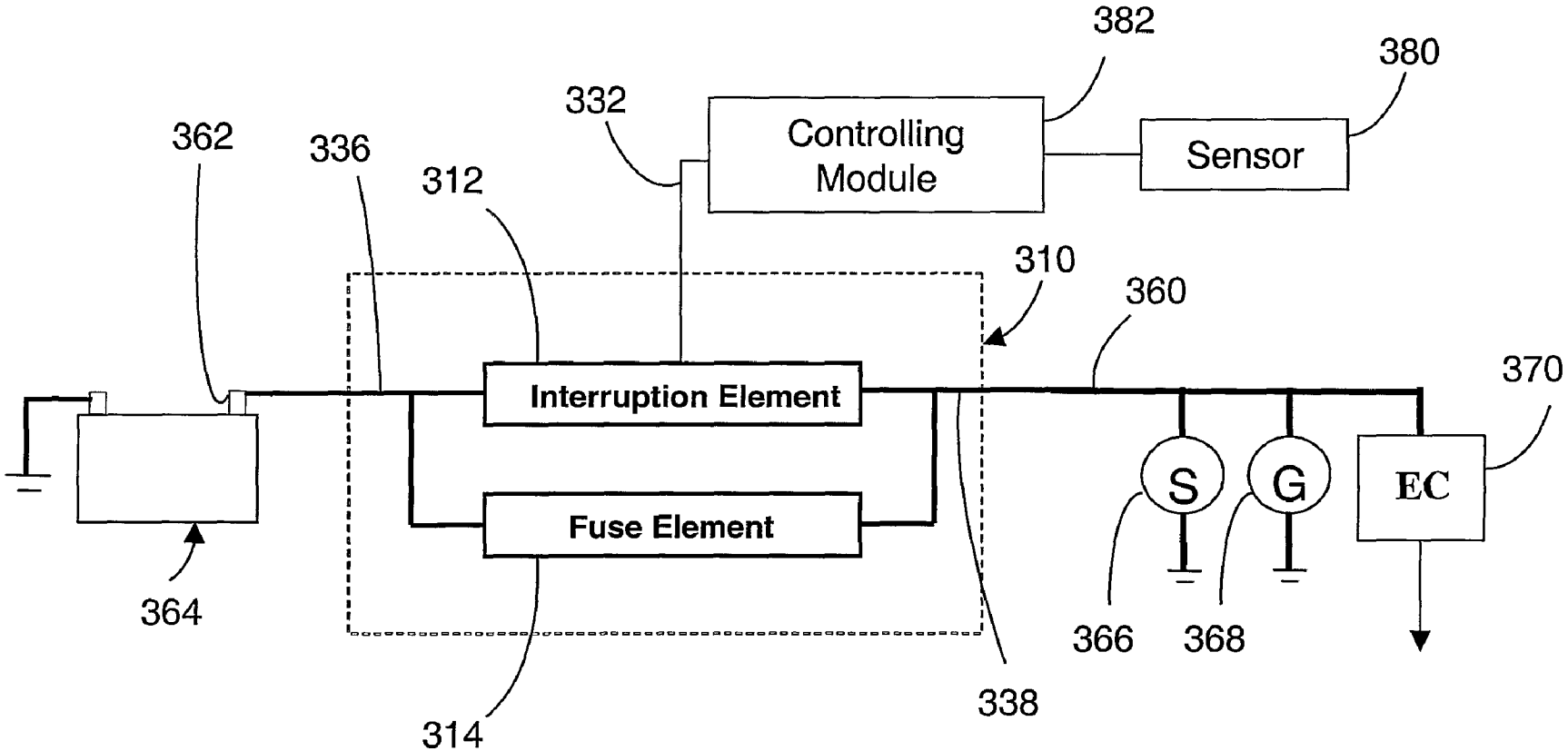
FIG. 3 is a schematic view depicting an exemplary embodiment of a circuit interruption device of the present invention connected as part of an automotive battery circuit.

FIG. 3 depicts an exemplary embodiment of a safety device or circuit interruption device 310 connected as part of an automotive battery circuit. Circuit interruption device 310 is connected in series in the primary circuit 360 between the positive post 362 of a DC power supply or storage battery 364 and vehicle electrical loads. Typical vehicle electrical loads, such as a starter motor 366, a generator 368 and an electrical center 370 are shown on FIG. 3. A sensor 380 detects an abnormal condition in which it is necessary to eliminate the capacity of interruption element 312 to carry current. The abnormal condition may include detection of an event such as a rapid deceleration or acceleration as in a vehicle collision (perhaps of sufficient force to cause the airbags to deploy). Sensor 380 may also be configured to detect other abnormal conditions such as an over-current condition in a protected circuit (as shown at 360). Sensor 380 is in communication with a controlling module 382, which is adapted to detect and process signals output by sensor 380. Controlling module 382 processes the signals emitted by sensor 380 and generates an interrupt control signal, which is communicated to interruption element 312 via wires 332.

In such an arrangement, circuit interruption device 310 operates as follows. Load current is conducted between connection points 336 and 338 via interruption element 312 and parallel fuse element 314. Sensor 380 detects an abnormal condition, indicating the desirability to eliminate the capacity of interruption element 312 to carry current. Controlling module 382 signals interruption element 312 to actuate and open the current path through interruption element 312, preferably prior to the occurrence of a collision induced short circuit of a protected battery cable (such as shown at 360) or electrical load (such as shown at 366, 368, 370) might occur. If a battery cable short circuit does occur subsequently, fuse element 314 opens the remaining parallel circuit and eliminates the short. In this case, protected circuit 360 is permanently interrupted from the battery positive post 362 with no means of resetting or closing the circuit (since doing so could cause an electrical/thermal event). On the other hand, if a battery cable short circuit does not occur in the collision event, fuse element 314 does not open the parallel circuit. Accordingly, fuse element 314 may be advantageously configured to provide sufficient current-carrying capacity to enable a necessary high-current use of the protected circuit, such as the re-starting of a vehicle engine. It is noted that such a need may exist in the event that a vehicle engine has stalled as a result of a collision or in the event the engine is turned OFF after a collision. In this second case, the fuse size, or rating, that may be required to accommodate re-starting of an engine after a collision (for a limited number of cycles) may be significantly smaller than the size or rating of a fuse that would be required if the fuse were configured electrically in series as part of the starter circuit, for the life of the vehicle.

In an exemplary embodiment, where circuit interruption device 310 is configured to protect an automotive battery circuit such as shown on FIG. 3, circuit interruption device 310 includes an electrical conductor (such as shown at 220 on FIG. 2*a*) having a resistance of less than 100 micro-ohms and fuse element 314 having a rating of 125 amps.

In either of the above cases (with or without a collision induced electrical short circuit on the battery cable), the circuit interruption device 310 is ultimately removed and replaced as part of the vehicle service repairs performed after a collision. These repairs may include inspecting the protected battery cable(s) for damage due to the collision with repair and/or replacement of the battery cable(s) as required prior to returning the vehicle to normal use.

Figure 4:
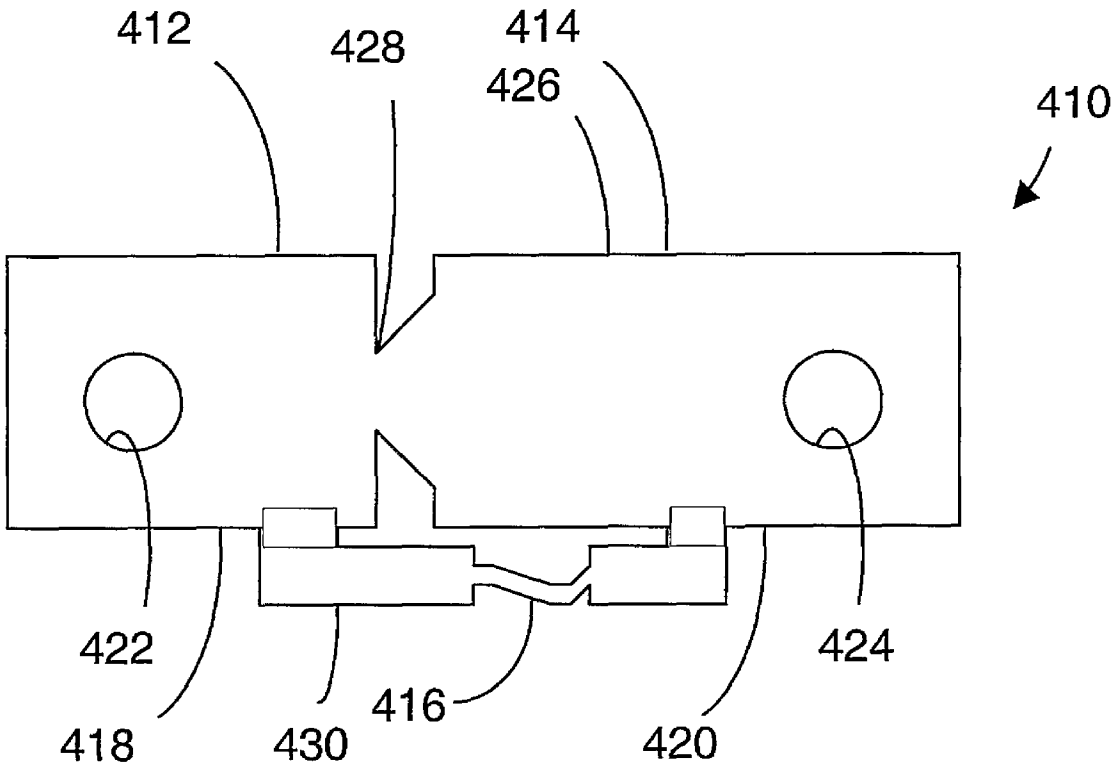
FIG. 4 is a plan view of an aspect of an exemplary embodiment of a circuit interruption device of the present invention.

Referring now to FIG. 4, an aspect of an exemplary embodiment of a circuit interruption device is disclosed. In this aspect shown generally at 410, a single stamping 412 includes both an electrical conductor 414 and a fuse element (fusible portion) 416. Electrical conductor 414 and fuse element 416 are connected at locations on the stamping 412 defined as first and second nodes 418, 420. Stamping 412 includes a hole 422, 424 at each end for bolting stamping 412 onto studs (not shown) for connection to load circuit connection points such as those shown at 336 and 338 in FIG. 3. Electrical conductor 414 of stamping 412 is incorporated in a generally rectangular first bus bar 426 that is notched or otherwise weakened to provide a narrow juncture 428, thus providing for ease of interruption via a current interrupter (such as one shown at 224 on FIG. 2*a*). Fuse element 416 of stamping 412 is provided by a second, smaller bus bar 430 that is a parallel electrical path for carrying current between first and second nodes 418, 420 located on opposite sides of juncture 428. The second bus bar 430 contains fuse element 416.

In an exemplary embodiment, fuse element 416 is configured to melt when a current above a predetermined level passes through the fuse element 416. A predetermined level for melting of fuse element 416 is dependent on the material, surface area and/or cross-sectional area of that particular fuse element 416.

In an exemplary embodiment, stamping 412 is made of a copper material having a thickness of approximately 1 to 2 mm. Electrical conductor 414 provides a current carrying capacity that is greater than the current carrying capacity of fuse element 416. In an exemplary embodiment, the size, shape, and material composition of electrical conductor 414 and fuse element 416 are selected to enable electrical conductor 414 to carry approximately 75% or more of the current flowing through stamping 412.

The operation of a circuit interruption device including stamping 412 operates in generally the same manner as circuit interruption devices 110, 210, 310 described above. Further, as demonstrated by circuit interruption device 210, it is possible to use an interruption element and a separate fuse element connected electrically in parallel with the interruption element, without integrating the fuse and interruption elements in a single stamping. It should be noted that any of these, and other embodiments, could readily be disposed in a housing along with a battery terminal clamp or other connections to assemble this device in an automotive circuit (as shown in FIG. 3) easily, and provide for inexpensive service replacement.

Referring now to FIG. 5*a*, an exemplary embodiment of a circuit interruption device 510 of the present invention includes a conductive stamping 512, a fuse 514, and a current interrupter 516 including a pyrotechnic component. Stamping 512 includes an electrical conductor 518 and a first and a second electrical connection portion 520, 522 at respective ends of the stamping 512. Fuse 514 extends between first and second electrical connection portions 520, 522 in parallel with electrical conductor 518. Current interrupter 516 is arranged and adapted to open the circuit path extending through electrical conductor 518 upon detection of a signal commanding current interrupter 516 to actuate.

FIG. 5*b* illustrates an aspect of circuit interruption device 510 shown on FIG. 5*a*. In this aspect shown generally at 540, stamping 512 includes electrical conductor 518 and first and a second electrical connection portion 520, 522 as also shown on FIG. 5*a*. Each electrical connection portion 520, 522 includes a hole 542, 544 respectively, for bolting stamping 512 onto studs (not shown) for connection to load circuit connection points such as those shown at 336 and 338 in FIG. 3. Electrical conductor 518 is notched or otherwise weakened to provide a narrow juncture 546, thus providing for ease of interruption via current interrupter 516 (shown on FIG. 5*a*).

Exemplary embodiment 540 further includes fuse 514 extending between first and second electrical connection portions 520, 522 parallel to electrical conductor 518. Fuse 514 includes first and second electrical contacts 548, 550, each respectively having a hole 552, 554 for bolted connection to respective first and second electrical connection portions 520, 522 of stamping 512.

Referring now to FIG. 6*a*, another exemplary embodiment of a circuit interruption device 610 of the present invention includes a conductive stamping 612, a fuse 614, and a current interrupter 616 including a pyrotechnic 20 component. Stamping 612 includes an electrical conductor 618 and a first and a second electrical connection portion 620, 622. Electrical conductor 618 extends between first and second electrical connection portions 620, 622. Fuse 614 is disposed between first and second electrical connection portions 620, 622 electrically parallel to electrical conductor 618. Current interrupter 616 is arranged and adapted to open the circuit path extending through electrical conductor 618 upon detection of a signal commanding current interrupter 616 to actuate.

FIG. 6*b* illustrates an aspect of circuit interruption device 610. In this aspect shown generally at 640, stamping 612 includes electrical conductor 618 and first and second electrical connection portions 620, 622 as also shown on FIG. 6*a*. First electrical connection portion 620 includes a hole 642 for bolting stamping 612 onto studs (not shown) for connection to a load circuit connection point. Second electrical connection portion 622 includes a clamp 644 to provide a connection to a positive terminal of a battery (not shown on FIG. 6*b*). Electrical conductor 618 is notched or otherwise weakened to provide a narrow juncture 646, thus providing for ease of interruption via current interrupter 616 (shown on FIG. 6*a*).

Embodiment 640 further includes fuse 614 disposed between first and second electrical connection portions 620, 622 electrically parallel to electrical conductor 618. Fuse 614 includes a first and a second electrical contact 648, 650 for bolted connection to stamping 612.

An exemplary embodiment of a method for enhancing the safety of an electrical circuit includes the steps of providing an electrical conductor; providing a fuse element; electrically connecting the fuse element to the electrical conductor in parallel; electrically connecting the electrical conductor and the fuse element in series with the electrical circuit; providing a sensor configured to detect a predetermined condition and configured to provide a signal indicating an occurrence of the condition; and providing a current interrupter capable of detecting the signal, the current interrupter being further capable of actuating in response to signal to sever the electrical conductor to eliminate the current carrying capacity of the electrical conductor.

Upon occurrence of a predetermined condition, the method further includes the steps of: detecting the occurrence of the predetermined condition; and severing the electrical conductor to interrupt a flow of current through the electrical conductor.

It should be noted that the exemplary embodiments shown and described herein are provided merely by way of example and are not intended to limit the scope of the invention in any way. Similarly, exemplary dimensions, ratios, materials and construction techniques are illustrative only and are not necessarily required to practice the invention. It is intended that the scope of the present invention herein disclosed should not be limited by the particular disclosed embodiments herein, but should be defined only by a fair reading of the claims that follow.

Further modifications and alterations may occur to others upon reading and understanding the specification. For example, a wire is shown connecting a controller to a circuit interruption element. Alternatively, a signal may be transmitted by a wireless approach. Alternatively, as a further example, a controller and/or sensor may also be packaged with a circuit interruption device of the present invention. It is intended to include all such modifications and alterations insofar as they come within the scope of the invention.

Having thus described the invention, what is claimed is:

1. A circuit interruption device, comprising:

an interruption element; and a fuse element, wherein said interruption element and said fuse element are coupled in parallel electrical connection, and wherein the interruption element is in communication with a sensor and the interruption element is configured to actuate in response to a predetermined output signal from said sensor, and wherein said sensor is configured to detect a vehicle deceleration rate.

2. A circuit interruption device, comprising:

an interruption element; and a fuse element, wherein said interruption element and said fuse element are coupled in parallel electrical connection, and wherein the interruption element is in communication with a sensor and the interruption element is configured to actuate in response to a predetermined output signal from said sensor, and wherein said sensor is configured to detect an airbag deployment.

* * * * *